United States Patent [19]

Linetsky

[11] 4,149,697

[45] Apr. 17, 1979

[54] CASTING AND STOCK-PILING OUTFIT

[76] Inventor: Mikhail Linetsky, #94-276 Adsum Dr., Winnipeg, Manitoba, Canada, R2P 0W2

[21] Appl. No.: 875,816

[22] Filed: Feb. 7, 1978

[51] Int. Cl.[2] ..... B28B 7/08

[52] U.S. Cl. ..... 249/120; 249/137; 425/439; 425/454

[58] Field of Search ..... 249/137, 120; 425/439, 425/454

[56] References Cited

U.S. PATENT DOCUMENTS

| | | | |
|---|---|---|---|
| 2,830,352 | 4/1958 | Gibson | 249/137 |
| 3,642,395 | 2/1972 | Dreher | 249/137 |
| 4,005,972 | 2/1977 | Sommers | 425/439 |
| 4,077,757 | 3/1978 | DeCoster | 425/454 |

FOREIGN PATENT DOCUMENTS

| | | | |
|---|---|---|---|
| 231644 | 4/1925 | United Kingdom | 425/454 |

*Primary Examiner*—John McQuade

[57] ABSTRACT

An outfit for manufacturing concrete units includes one frame, which can move along a rail-track, and two detachable forms-tilters on it. The length of the unit made in the forms can be varied. Each form has also detachable equipment (edges, dies, and dividing bars). Before stripping the units, the side edges of the form are thrown aside and the bottom edge is taken away. A detachable hinged clip which is fixed on the bottom side is moved into a working position. Then the form is turned over 90°, and the outfit moves to a rack. The top edge is thrown back, the clip is released, and the unit falls down on cushions. The outfit operates in the same manner on the other side of the rail-track. It is possible to manufacture in one form two or more units at the same time with corresponding increase in quantity of clips on the bottom side of the form. The present outfit can be successfully used for casting, stripping, and stock-piling without the use of a crane different types of units both at the plant and at the construction site.

2 Claims, 5 Drawing Figures

CASTING AND STOCK-PILING OUTFIT

The invention relates to molding systems, utilized in precast concrete industry.

It is known that the stripping and stock-piling of units is carried out with cranes.

Besides, in order to mold different types of units in one form, it is necessary to bear the high expenses for edge and die changes. The same problem occurs when the overall dimensions give an opportunity to mold in one form two or more units at the same time.

The object of the invention is to provide for stripping and stock-piling capability of a molding device. Another object is to provide for quick changing of forms-tilters of the outfit. The third object is to provide for facile changing of edges, dies, and dividing bars of the forms.

A better understanding of the invention will be derived by reference to ensuing specifications and accompanying a drawing wherein.

Figure 2:
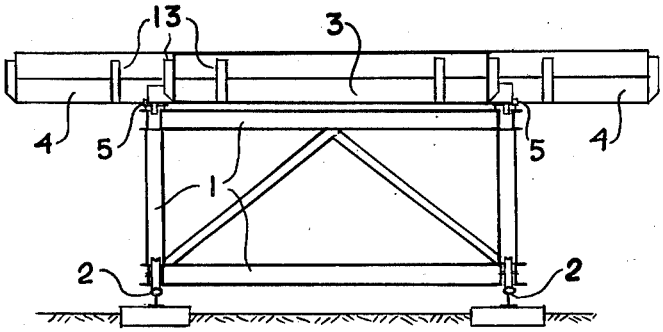
FIG. 2 is a view of the outfit across the rail-track.

Referring to the drawings, the presented outfit consists of one frame 1, which can move along a rail-track 2, and two detachable forms-tilters 3 and 4. As shown in FIG. 2, the length of the forms can vary.

Figure 1:
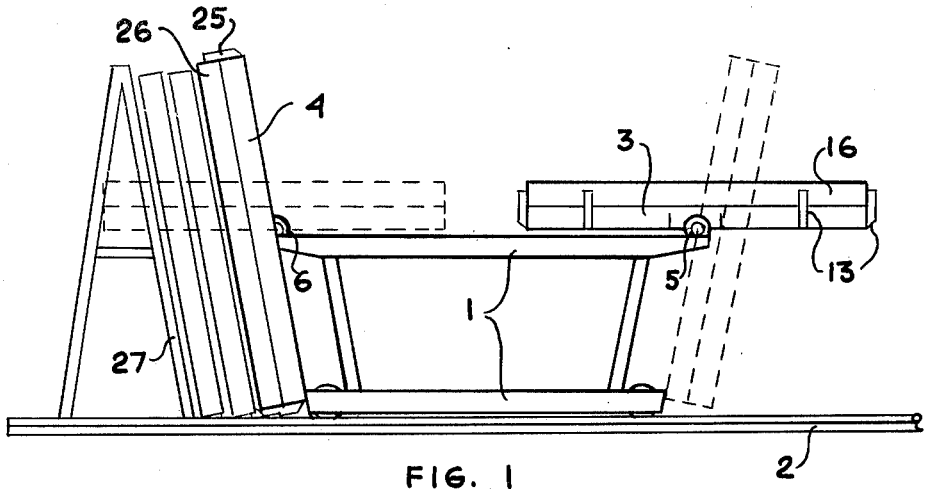
FIG. 1 is a view of the present invention along a railtrack; the right part shows the form in a horizontal position, the left part shows the form while stock-piling the unit. The dotted lines show other extreme positions of forms.

The basic part of the form is simple steel table with turning ability round its bearings 5 and 6 (FIG. 1).

Figure 3:
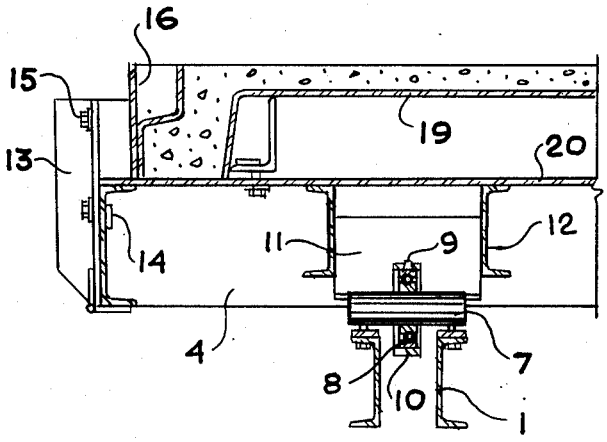
FIG. 3 is a partial cross-sectional view of the form, showing an edge and die and bearing a form-tilter.
Figure 5:
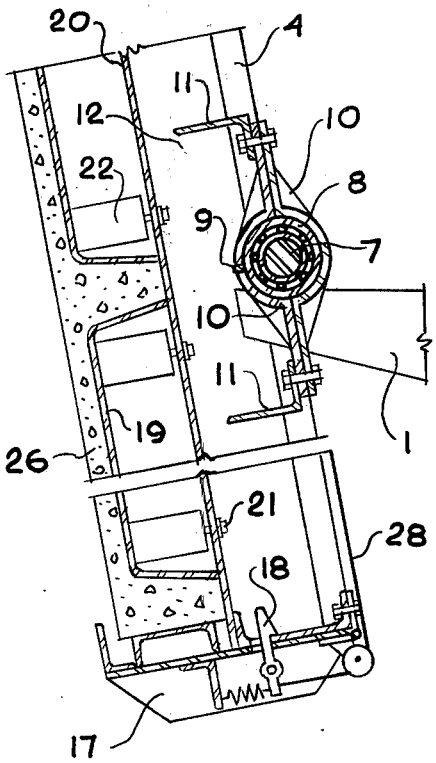
FIG. 5 is a partial cross-sectional view of the turned form with its bearing and a clip while stock-piling a unit.

As shown on FIGS. 3 and 5 the bearing 6 of a long form-tilter 4 consists of a shaft 7, motionlessly fixed on the frame 1 of the outfit, ball bearing 8 with a pin 9, detachable bearing strap 10, which is bolted to angles 11, welded to beams 12.

FIG. 3 shows also the structure of detachable edges. There are hinged cleats 13 along the perimeter of the form (in two's on each side). Each of these cleats has two fastenings with spring-lock washers. One of them, 14, fixes the cleat 13 in a working position, another one, 15, fixes detachable edge 16 to the cleat 13.

Also, in the middle of the bottom side of the form there is a hinged clip 17 (FIG. 5) with a spring lock 18. Until the bottom edge is removed from the form, the clip 17 is in a thrown back position.

Figure 4:
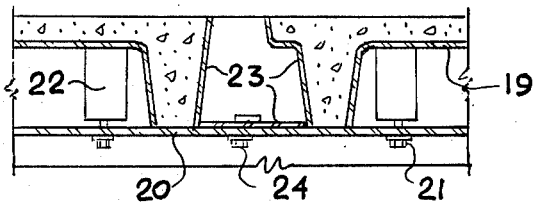
FIG. 4 is a partial cross-sectional view of the form, showing a dividing bar and dies.

To provide the forms with detachable dies 19 (FIGS. 3-5), they are fixed to a pan 20 from below with fastenings 21 and clamps 22, welded to the dies 19.

If the form has to be used for molding two or more units at the same time, the quantity of clips 17 accordingly increases. In that case it's possible to use dividing bar 23 (FIG. 4), which is fixed to the pan 20 with fastenings 24.

While stripping the units, the side edges should be thrown aside and the bottom edge should be taken away.

Then the hinged clip 17 (FIG. 5) is fixed in working position, the form 4 is turned over 90°, and the outfit moves to the rack 27 (FIG. 1). The top edge 25 and the hinged clip 17 keep unit 26 from overturning. After the outfit stops, the top edge 25 is thrown back and the clip 17 is released by turning the lock 18 (FIG. 5) with a pull rope 28, and the unit 26 falls down on elastic cushions and leans against another unit. The form-tilter 3 strips and stock-piles units the same way, moving to the rack on the other side.

What is claimed is:

1. An outfit for horizontal casting, stripping and stock-piling concrete panels, comprising:

a rail-track;

a wheeled frame, movable along said rail-track back and forth;

two form-tilters, each supported by said frame and rotatable around a horizontal axis, directed across the rail-track;

a detachable edge on each form-tilter, which would have become the bottom edge after tilting, but must be taken away before that;

a hinged lock bracket on each form-tilter which replaces said edge, keeps the panel in place during tilting and moving of form-tilter and releases the panel;

two side edges on each form-tilter which should be thrown aside before said form-tilter is tilted;

an edge on each form-tilter which is the top one after tilting; said top edge, functioning independently, keeps the panel in place during tilting and moving of the form-tilter, and it should be thrown back before releasing the panel;

racks on both ends of the rail-track; said racks accomodate released panels.

2. An outfit as claimed in claim 1, wherein:

said top and two side edges on each form-tilter are connected to hinged cleats which are fixed to a border of each form-tilter; and further comprising detachable dies, fixed through clamps to a pan of each form-tilter;

and detachable dividing bar or bars, fixed to each pan.

* * * * *